US006991401B1

(12) United States Patent
Caron

(10) Patent No.: US 6,991,401 B1
(45) Date of Patent: Jan. 31, 2006

(54) COMPACTOR WHEEL WITH TRASH EXCLUSION PROPERTIES

(75) Inventor: James Oliver Caron, Modesto, CA (US)

(73) Assignee: Caron Compactor Company, Escalon, CA (US)

( * ) Notice: Subject to any disclaimer, the term of this patent is extended or adjusted under 35 U.S.C. 154(b) by 0 days.

(21) Appl. No.: 11/098,919

(22) Filed: Apr. 5, 2005

(51) Int. Cl.
*E01C 19/26* (2006.01)

(52) U.S. Cl. ..... 404/124; 404/121

(58) Field of Classification Search ..... 404/121, 404/122, 124, 128; 37/452, 454, 456
See application file for complete search history.

(56) References Cited

U.S. PATENT DOCUMENTS 3,450,013 A * 6/1969 Peterson ..... 404/128
3,823,983 A * 7/1974 Peterson ..... 301/43
3,922,106 A * 11/1975 Caron et al. ..... 404/121
4,919,566 A * 4/1990 Caron et al. ..... 404/121
5,967,242 A * 10/1999 Caron et al. ..... 172/817
6,682,262 B2 * 1/2004 Caron et al. ..... 404/124
2004/0033107 A1 * 2/2004 Caron et al. ..... 404/124

FOREIGN PATENT DOCUMENTS

WO WO 3078738 A1 * 9/2003

* cited by examiner

*Primary Examiner*—Thomas B. Will
*Assistant Examiner*—Alexandra Pechhold
(74) *Attorney, Agent, or Firm*—Donald N. MacIntosh

(57) ABSTRACT

Landfill compactor vehicles having wheels equipped with wedge shaped cleats tend to accumulate about the vehicle's axle trash such as cable, wire, rope and the like debris requiring daily removal to permit unobstructed axle rotation. The wheel construction of this invention provides compaction cleats of two types, contour and traction, in rows positioned across the width of the wheel with substantially no cleat free zone adjacent the wheel edges but with a row of contour teeth arranged adjacent the wheel's inner edge thus affording trash exclusion properties to the compactor wheel.

7 Claims, 8 Drawing Sheets

COMPACTOR WHEEL WITH TRASH EXCLUSION PROPERTIES

FIELD OF THE INVENTION

This invention relates to the construction of land fill compactor wheels wherein wire, cable, refuse and debris entrainment around the landfill compactor's wheel axles can be a persistent operational and maintenance problem.

BACKGROUND OF THE INVENTION AND PRIOR ART

Landfill compactors are configured with wheels especially adapted to operate in sanitary land fills or refuse dumps. In that environment the first priority for such equipment is to obtain maximum compaction density of the materials deposited in the landfill thereby maximizing the capacity of the landfill. Typically a landfill compactor vehicle is self propelled and equipped with four large steel wheels. These wheels are each provided with an array of cleats that extend radially from a cylindrical wheel drum. By reason of the high compactor vehicle weight, sometimes amounting to 120,000 pounds (about 54,431 kg), the cleats mounted on the wheel drum apply localized forces to crush, grind and generally aggressively knead the refuse into the landfill mass.

The number of cleats mounted on a given wheel drum has a direct effect upon the aggressiveness of the compaction action and the resultant compaction density in the landfill. Hence a smaller number of cleats on a wheel drum of a given circumference, say 28 to 30 cleats on a 65 inch (1.65 meter) diameter drum, will result in less compaction density than the configuration wherein the wheel drum is equipped with a larger number of cleats, say 45 to 58 cleats. Clearly a larger number of cleats is desirable to achieve higher compaction densities., the compactor wheel sizes being otherwise equal or equivalent. The efficiency gain is apparent from actual observations of the equipment in use on land fill sites.

In an endeavor to minimize entrainment of debris in the region of the compactor vehicle wheel axle assembly, a troublesome problem at land fill sites, the prior art has shown that leaving a cleat free zone or large cleat offset adjacent the inner edge of the compactor wheel, such as by eliminating an entire circumferential row of cleats from the wheel, is generally effective. That arrangement provides about 25% fewer cleats available for aggressive compaction action. Also taught was a trash barrier comprising a circumferential solid or fluted flange mounted at the inner edge of the compactor wheel. This was intended to act as a barrier to reduce wire, cable and trash buildup around the compactor axles. Not uncommonly, the circumferential flange received higher wear that the nearby cleats and needed replacement long before the cleats needed replacement. The foregoing structures are shown in U.S. Pat. No. 5,687,799 issued Nov. 18, 1997 and U.S. Pat. No. 5,769,507 issued Jun. 23, 1998.

Common to both the '799 and '507 patents is that the cleats welded to the wheel drums were all of the same configuration, basically traction affording cleats. Thus, reducing the number of cleats available for trash compaction purposes proportionately reduced the cleats available for traction purposes. The tradeoff for attacking the trash entrainment problem on the wheel axles, as taught by the prior art, was to diminish the traction efficiency of the entire compactor vehicle. The compactor therefore was required to make many more passes over the landfill materials to achieve the intended compaction density. Consequently, higher fuel and operational wear costs were an undesirable result of leaving cleat free zones or a large offset of a cleat row on the compactor wheels.

SUMMARY OF THE INVENTION AND OBJECTS

In summary the invention resides in a compactor wheel with trash exclusion properties. The wheel is constructed for mounting on an axle of a compaction vehicle and includes an outer cylindrical rotatable drum having an inner peripheral edge adapted to be disposed adjacent to the compaction vehicle with the outer peripheral edge disposed away from the compaction vehicle. A plurality of upstanding compaction cleats are circumferentially spaced across the face of said drum and rigidly mounted thereto. The cleats are of two types, a contour cleat with a base generally elongated in the rolling direction and with a trapezoidal profile in the axial direction. The second type of compaction cleat is generally a wedge shaped form with the broad wedge faces disposed in the rolling direction so as to transmit traction forces into the landfill. A continuous row of cleats of the first type is rigidly fixed adjacent to the inner peripheral edge of the drum. And, rows of cleats of both the first and second types are disposed on the drum outwardly of the first mention row of cleats. From the inner peripheral edge to the outer peripheral edge there is no cleat free zone.

An object of the invention is to provide a compactor wheel with trash exclusion properties that serves to apply high crushing, grinding and compaction forces to a sanitary landfill without minimizing the number of compaction cleats mounted upon the wheel.

Another object of the invention is to provide an efficient and effective trash compactor wheel that maintains the customary application of forces needed for maximum compaction while minimizing, if not entirely eliminating, the attraction of wire, cable, rope and the like trash into the compactor wheel axle areas.

Yet another object of the invention is to provide on a compactor wheel a variety of patterns of compaction cleats in two types arranged on a wheel drum that do not invite snagging of cable, wire or the like materials and is so constructed to afford relatively uniform wear of the entire set of cleats to enable replacement of a complete set of worn cleats all at the same time without the need for interim rebuilding of fabricate wire barriers of the prior art.

Still another object of the invention is to provide a compactor wheel that enables efficient operation of the compactor vehicle with concomitant savings of fuel and vehicle operational wear and maintenance, materially reducing the need for trash removal about the vehicle's axles, a safety hazard that can be eliminated.

Additional objects and features of the invention will be readily understood and appear below in the drawings and description of the preferred embodiments of my invention.

DESCRIPTION OF THE PREFERRED FORMS OF THE INVENTION

Figure 1:
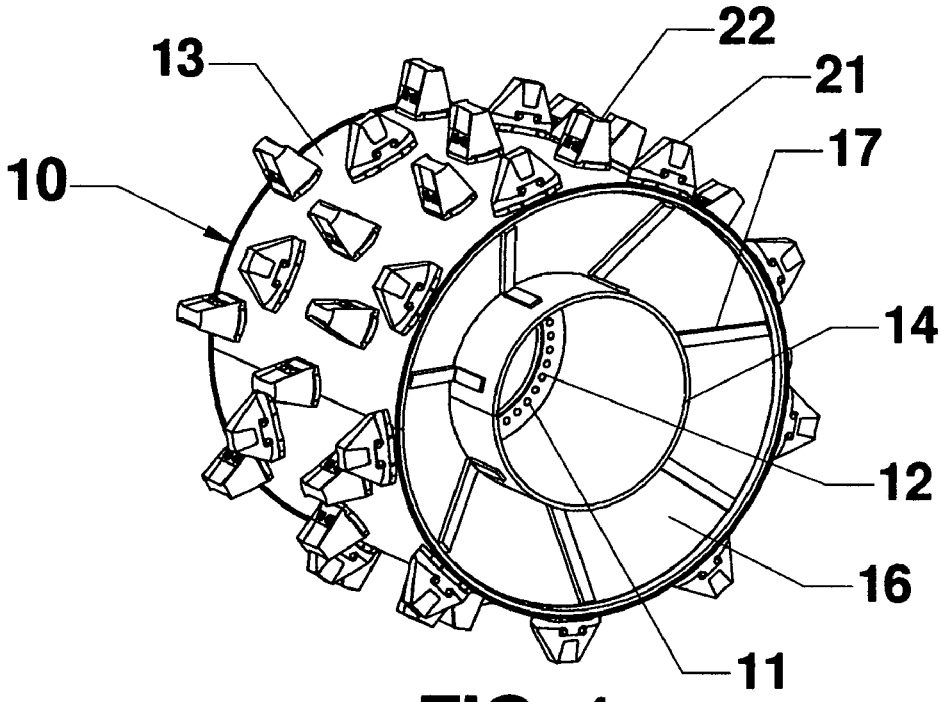
FIG. 1 is a perspective view of a compactor wheel made in accordance with the principles of the present invention, the view prominently showing the inner disposed side of the wheel, the side adjacent the associated tractor vehicle wherein the inner row of cleats are disposed closely adjacent the wheel rim edge.
Figure 2:
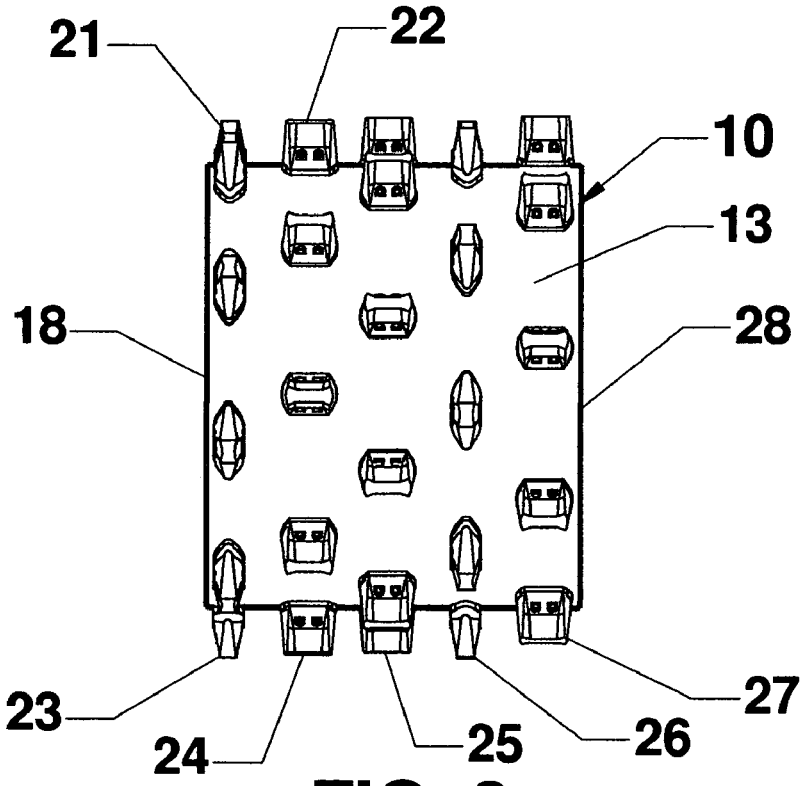
FIG. 2 is an elevation view of the wheel of FIG. 1.

Referring to the drawings FIGS. 1 and 2, there is shown a first preferred embodiment, compactor wheel 10, that carries out the principles of the present invention. The wheel 10 is adapted to be operatively mounted on an axle of a compactor vehicle (not shown) it being understood that each of the four axles of the vehicle is equipped with one such wheel or the like. To effect mounting of the wheel 10 upon the vehicle axle a mounting ring 11 is provided with a plurality of holes 12 for receiving the wheel mounting studs of the associated vehicle axle (not shown) to be secured thereto with lug nuts (not shown) in the customary manner. The perspective view of FIG. 1 shows most prominently the inner face of the wheel, the face or side disposed closest to the compactor vehicle when the wheel 10 is mounted on the vehicle axle.

The wheel 10 further includes an outer drum 13, an inner drum 14 to which the mounting ring 11 is attached. A conically formed web member 16 rigidly secures the inner drum 14 to the outer drum 13. Radially extending stiffening ribs 17 are fixed upon the web member 16 at circumferentially spaced intervals so as to render the wheel 10 a rugged structure operable over a long effective service life. The inner peripheral edge 18 of the outer drum 13 is shown in FIGS. 1–2 and is the circumferential element disposed closest to the compactor vehicle when the wheel 10 is operatively mounted.

Compaction cleats having two distinctive configurations 21–22 extend radially outwardly from the outer drum 13 and serve the highly desirable functions of crushing, grinding and kneading the refuse and the like into the landfill mass. Cleats of these configurations are disclosed in U.S. Pat. No. 6,682,262 granted Jan. 27, 2004 and U.S. Pat. No. 4,919,566 granted Apr. 29, 1990, both assigned to Caron Compactor Company, Inc. of Escalon, Calif. and both are incorporated herein by reference and are hereby made a part of this disclosure.

Figure 9:
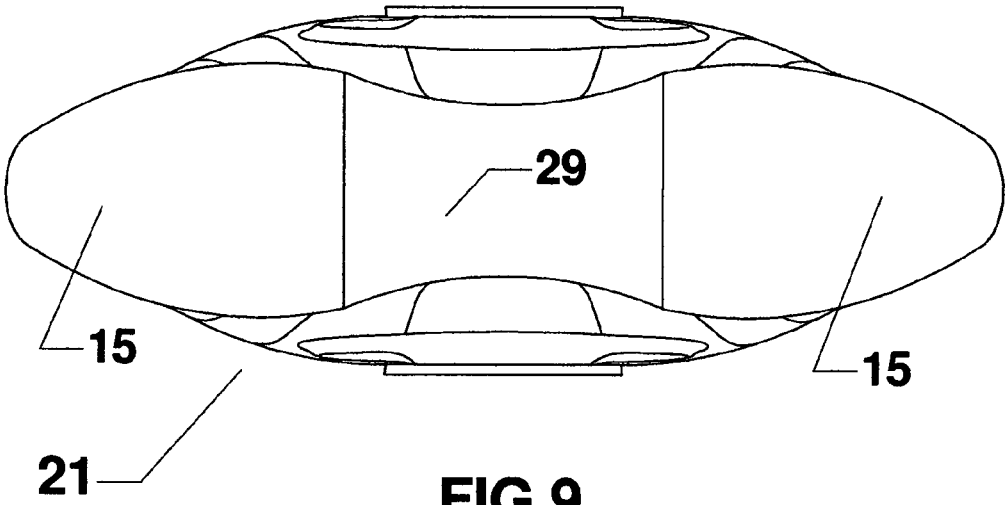
FIG. 9 is a plan view from above of a contour cleat.
Figure 12:
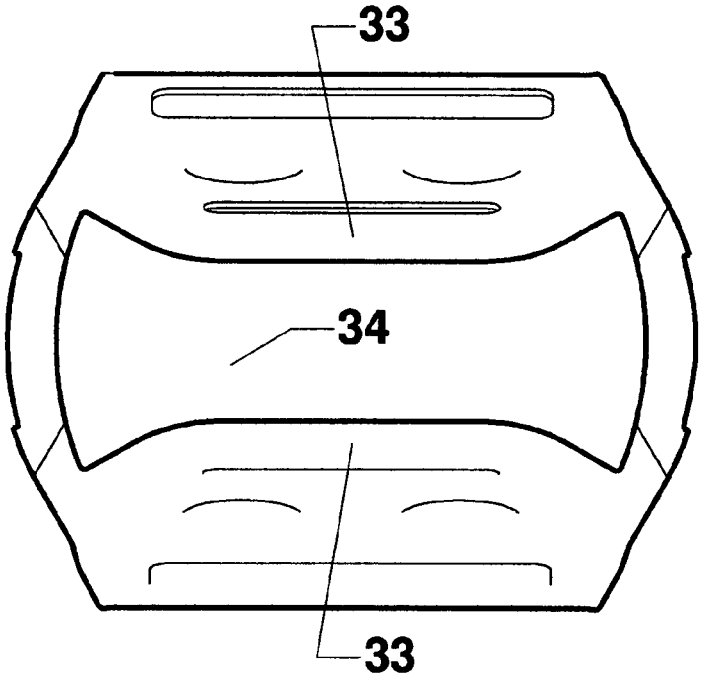
FIG. 12 is a plan view from above of a traction cleat.
Figure 10:
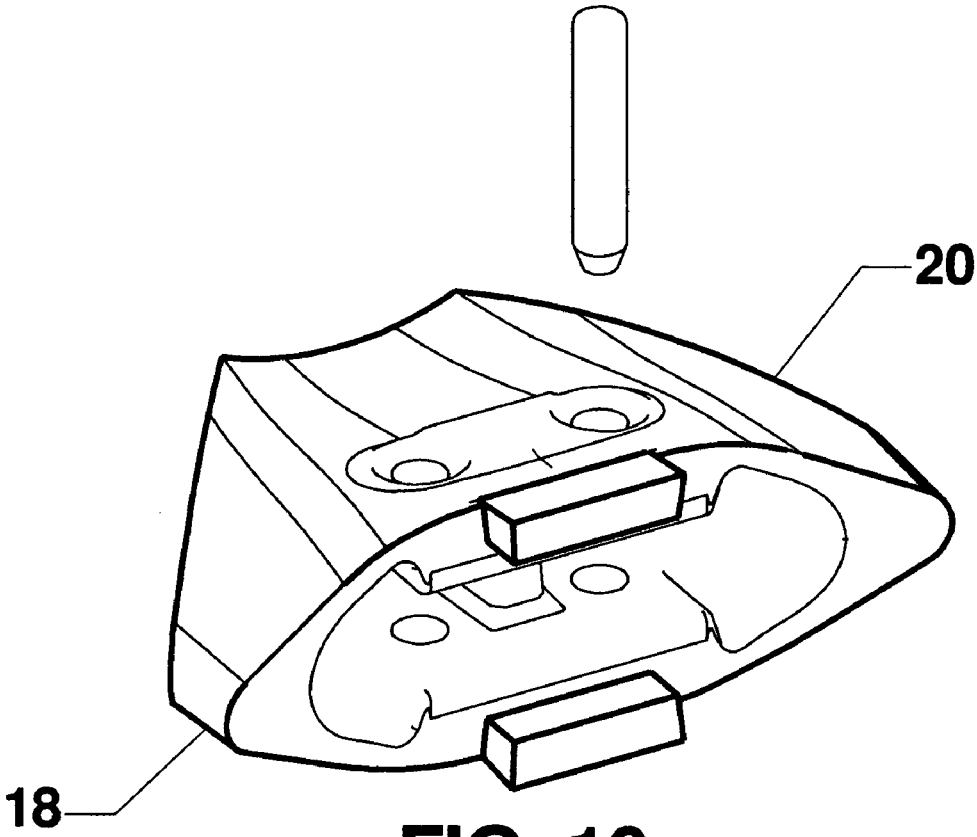
FIGS. 10 and 11 are exploded perspective views of the contour cleat of FIG. 9.
Figure 11:
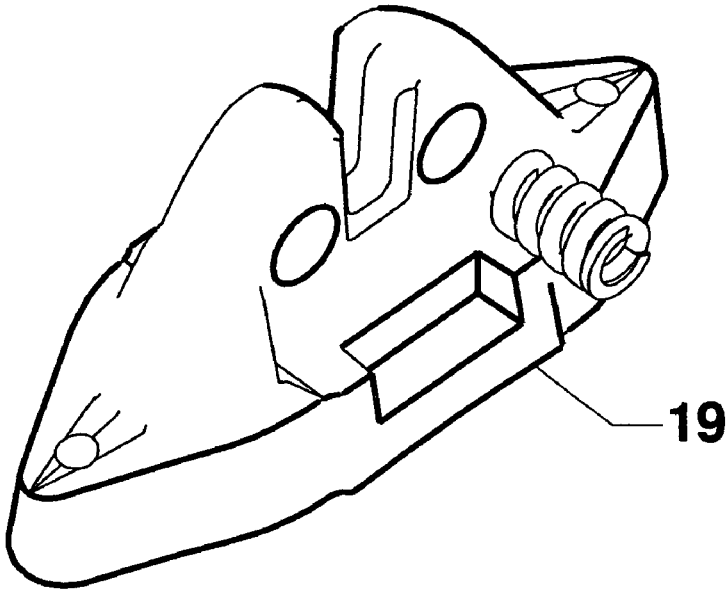
Figure 13:
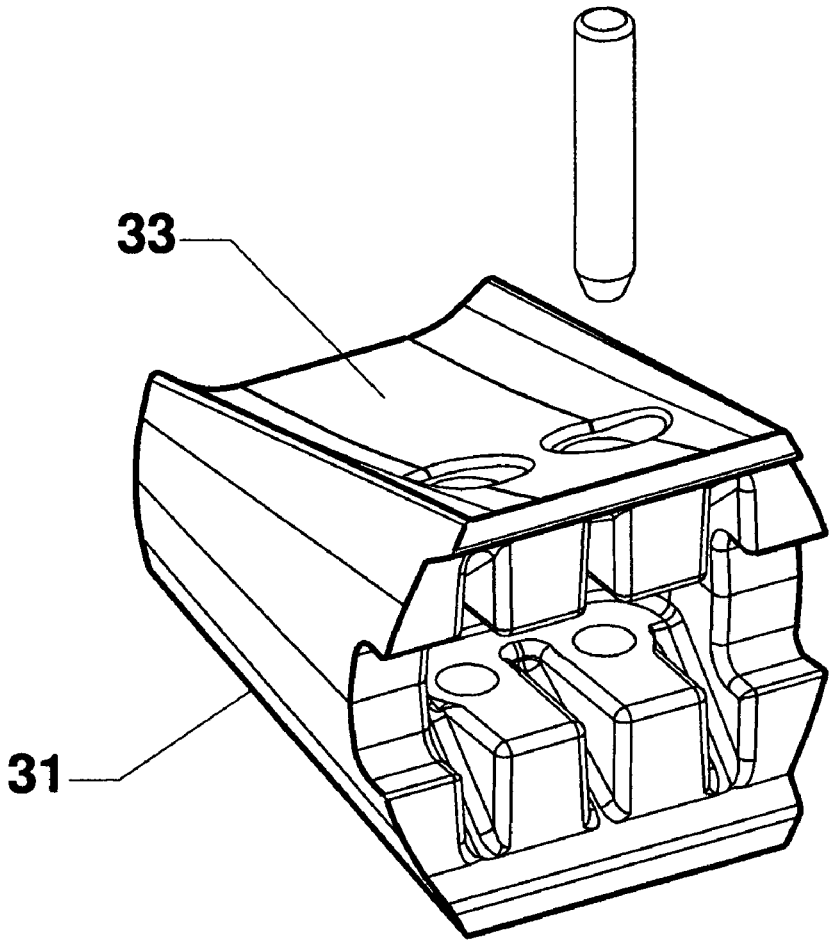
FIGS. 13 and 14 are exploded perspective views of the traction cleat of FIG. 12.
Figure 14:
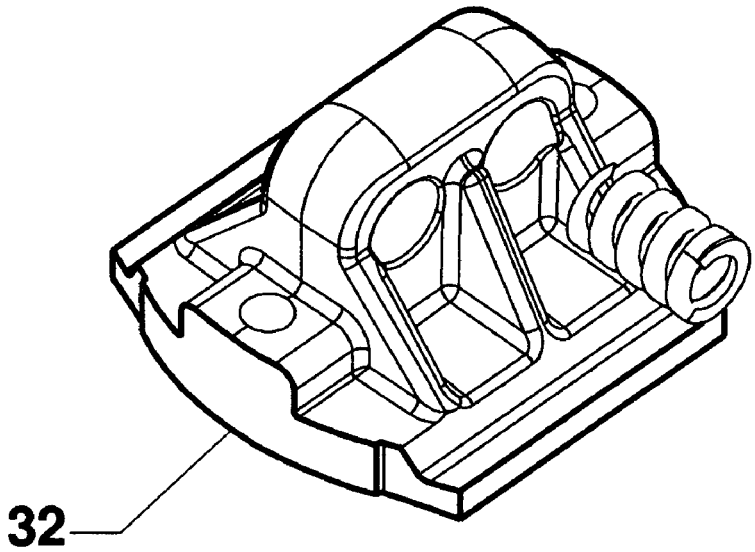

More specifically, as shown in FIG. 2 the cleats 21–22 are rigidly mounted on the drum 13 in a plurality of circumferentially extending rows, the rows being transversely spaced across the face of the drum and are arranged in a generally staggered, non-aligned pattern so as to provide space between the rows for passage of debris during the compaction operations. Except for the inner row of cleats 23 those in rows 24–27 may be all of the same type, either contour or traction, or mixed as alternately traction and contour as the application dictates. Cleats 21 have been characterized and described in the '262 and '566 patents and in other literature as "contour cleats" having a shape suggestive of an US Army "overseas cap" namely: elongated in one direction and with tapered ends and being trapezoidal in profile. Here the cleats 21 are secured on the drum with the long dimension extending in the direction of drum or wheel rotation as clearly shown in FIGS. 1 and 2. A circumferential row 23 of cleats 21 is mounted adjacent to the inner edge 18 of the drum 13 so that there is no substantial cleat free zone between the inner cleat row 23 and the inner edge 18. In the prior art the cleat free zone at the inner edge of the wheel was believed to be very important in reducing debris entrainment about the vehicle's axles. The subject cleats 23, shown in detail clearly in FIGS. 9–11, are arranged as disclosed in the drawings to create the trash exclusion properties for the wheel 10 while achieving high compaction forces attributable to the larger number of cleats mounted on the wheel 10 than in the prior art referred to above. As clearly illustrated in FIGS. 9–11, the contour cleats 21 are elongated in plan and taper at each end. In side elevation, as indicated in FIGS. 10–11, the cleats 21 are generally trapezoidal and each has fore and aft compaction faces 15 which extend downwardly from the top face 29 to the base or adapter 19. The construction of the adapter or base 19 which is welded to the outer drum 13 and the components that enable its coupling to the wear cap 20 are described in U.S. Pat. No. 6,682,262, granted Jan. 27, 2004 and as shown herein are self evident in function and arrangement and are not further described. The traction cleats 22 are shown in detail in FIGS. 12–14 and each includes a generally wedge shaped wear cap 31 coupled to a rectangular base 32 which itself is welded to the outer drum 13. The traction cleat 22 at its wear cap 31 presents broad compaction faces 33 on either side of the wedge shaped cleat. A blunt end or land 34 supplies enormous crushing action to the ground as the wheel 10 rotates. The components that enable the connection between the wedge shaped wear cap 31 and the rectangular base 32 are apparent in FIGS. 13 and 14 and are also well described in U.S. Pat. No. 6,682,262 granted Jan. 27, 2004 and will not be further described herein. As evident from FIGS. 1–8, the contour cleats 21 are mounted on the outer drum 13 with their tapered ends pointing in the direction of roll. The traction cleats 22 are mounted on the outer drum 13 with their broad wedge faces disposed axially of the compactor wheel and facing the direction of roll thereby enabling tractive forces to be applied from the wheel to the landfill mass.

Five cleat rows 23–27 are transversely spaced across the drum 12 substantially from the inner edge 18 to the outer edge 28 leaving no substantial space adjacent the inner wheel edge without a cleat 21.

It has been found desirable to arrange the traction cleats 22 in rows 24, 25 and 27, all outwardly of the inner row 23, so as to achieve the aggressive action forces on the landfill materials. A second row 26 of contour cleats 21 may be disposed among the rows of traction cleats 22 as shown in FIG. 2. Thus the wheel 10 has several circumferential rows of cleats of first and second types transversely spaced across the drum 13 substantially from edge 18 to edge 28 in a configuration found to exclude trash entrainment about the compactor vehicle's axles.

Figure 3:
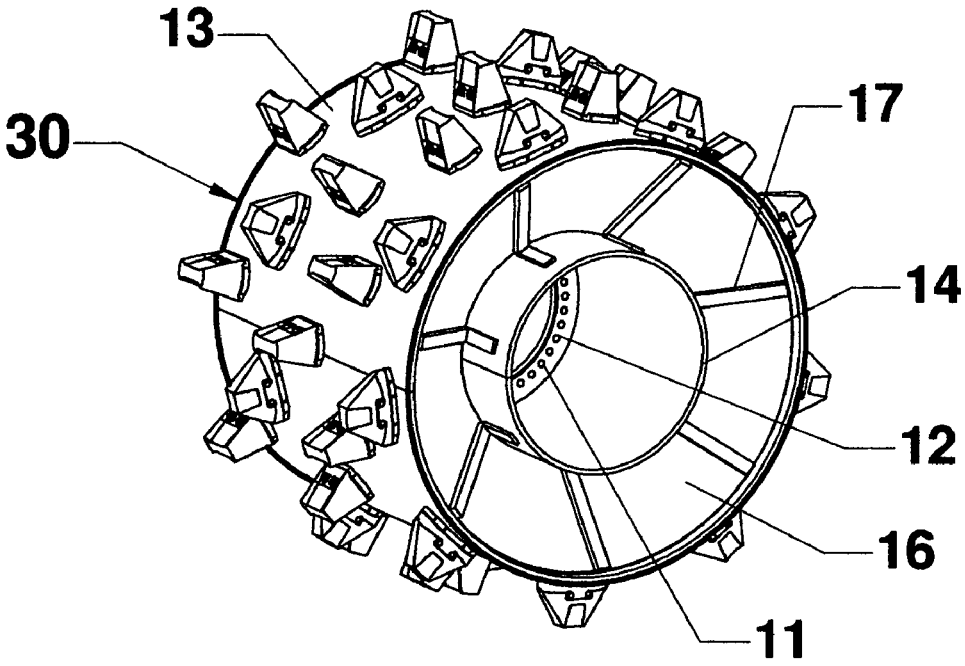
FIG. 3 is a perspective view like FIG. 1 but showing another embodiment of the invention with the inner row of cleats set back a minor distance, less than the width of an individual cleat, from the wheel rim edge.
Figure 4:
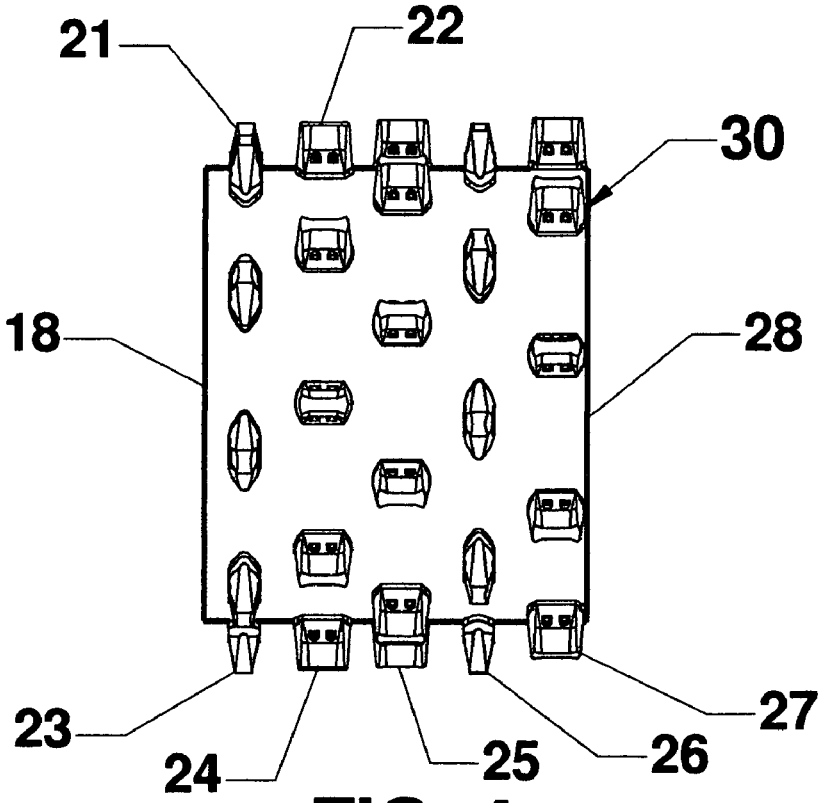
FIG. 4 is an elevation view of the wheel of FIG. 3.

Referring to the drawings FIGS. 3 and 4, there is shown a second preferred embodiment, the compactor wheel 30, that carries out the principles of the present invention. For the reason that similar elements from the embodiment of FIGS. 1–2 and 9–13 exist in this embodiment the designator numerals will be carried over except where a different function is referred to. Thus, designator numerals 11–14, 16–17, 21–28 as well as those used in FIGS. 9–13 refer to the elements and functions described above and will not be described further.

A visual comparison of FIG. 4 with FIG. 2 reveals that generally the entire set of cleats in rows 23–27 are shifted towards the outer circumferential rim or edge 28 a minor distance less than the width of the traction cleat 22. After a period of testing on landfill materials this pattern was found to effectively exclude trash buildup in the region of the compactor's axles.

Figure 5:
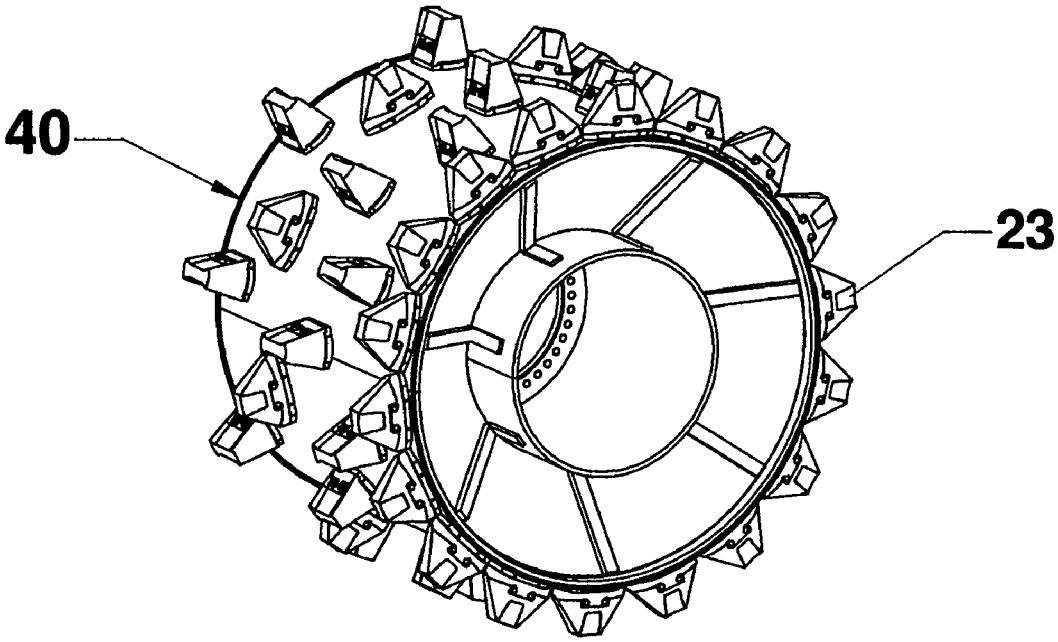
FIG. 5 is a perspective view like FIGS. 1 and 3 but showing yet another embodiment of the invention with the inner row of cleats disposed "heel to toe" in a continuous row along the wheel circumferential edge.
Figure 6:
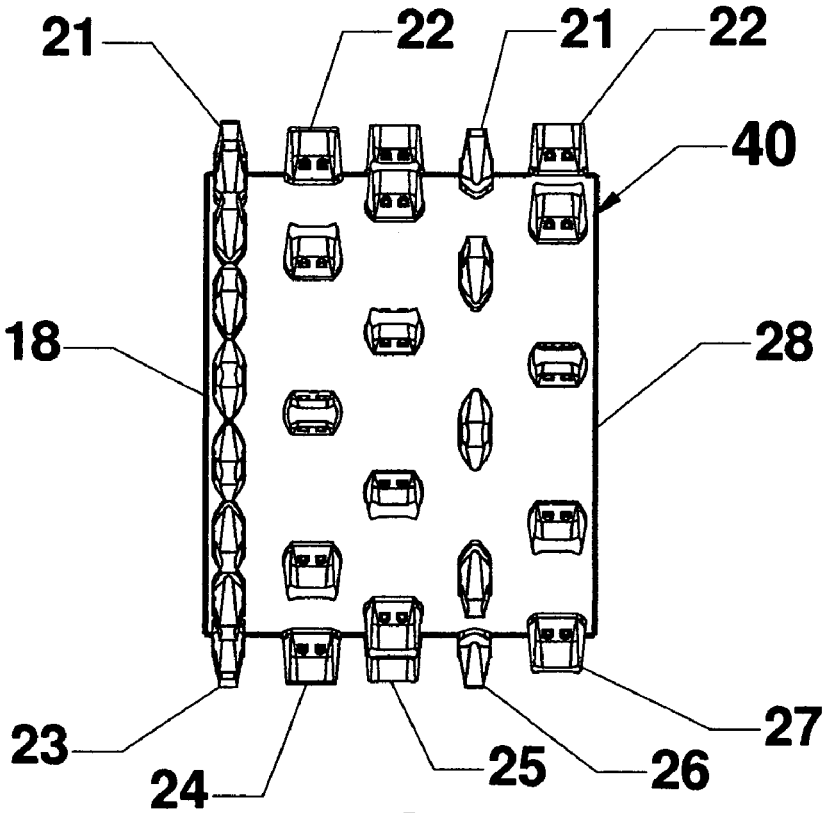
FIG. 6 is an elevation view of the wheel of FIG. 5.

Referring to FIGS. 5 and 6, there is illustrated a third preferred embodiment of the invention, the compactor wheel 40. Like elements from the embodiments of FIGS. 1–4 and 9–13 exist in this embodiment and for that reason the designator numerals will be carried over as mentioned in paragraph [0032] above. A prime (') to the designator numeral is shown to emphasize a noteworthy distinction.

A visual comparison of FIGS. 5 and 6 with FIGS. 1 and 2 reveals that the inner row 23' of contour cleats 21 is fixed to the outer drum 13 closely adjacent to the inner circumferential wheel edge 18. The cleats are welded to the drum in a "heel-to-toe" cleat to cleat relationship so much so that the cleat ends virtually touch, as shown clearly in FIG. 5. This pattern has been tested and found to effectively exclude trash buildup in the region of the compactor's axles.

Figure 7:
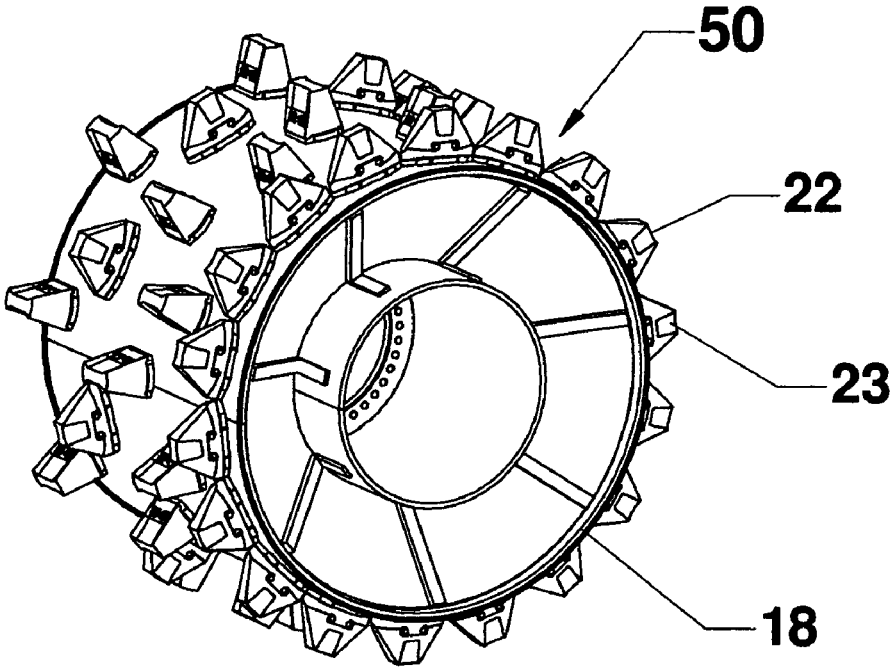
FIG. 7 is a perspective view like FIGS. 1, 3 and 5 but showing still another embodiment of the invention with the inner row of cleats disposed set back a minor distance from the wheel rim edge.
Figure 8:
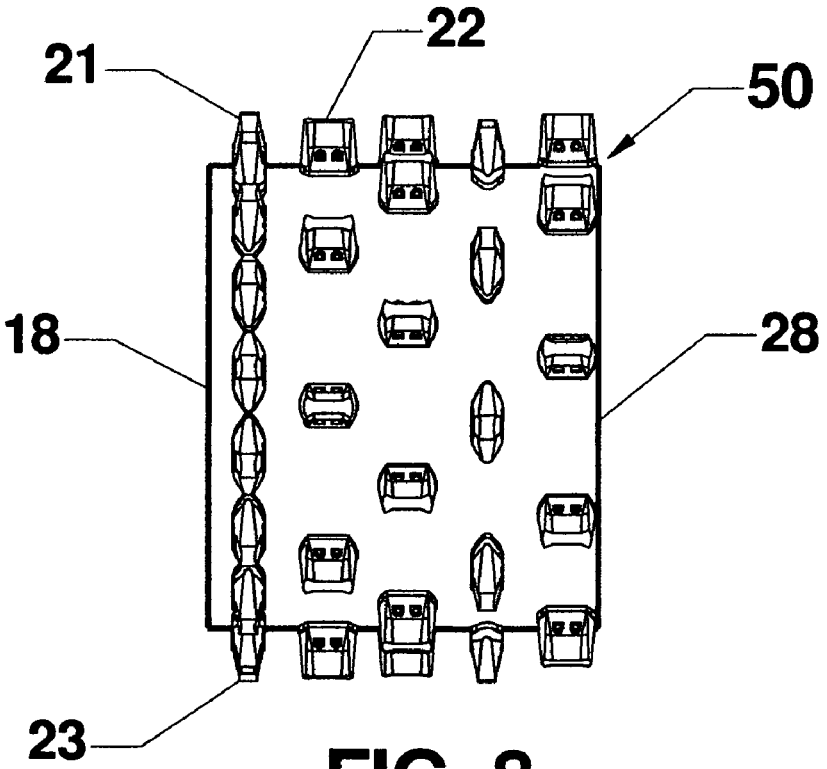
FIG. 8 is an elevation view of the wheel of FIG. 7.

Referring now to FIGS. 7 and 8, there is shown a fourth preferred embodiment of the invention, the compactor wheel 50. Like elements from previously mention embodiments being again used the designator numerals are carried over as mentioned in paragraph [0032] above. A double prime {"} to the designator numeral is shown to emphasize a noteworthy distinction.

A visual comparison of FIGS. 7 and 8 with FIGS. 5 and 6 reveals that the inner circumferential row of cleats 23" is welded to the drum 13 adjacent to the inner drum edge 18 such that a short offset is present between the row of contour cleats and the drum edge 18. The offset is less than the width of a traction cleat 22 as is apparent. As in FIG. 5, the contour cleats 21 in row 23" of FIGS. 7 and 8 are arranged in "heel-to-toe" continuously around the entire outer drum 13. This pattern has been field tested and found to effectively exclude trash buildup in the region of the compactor's axles with substantial savings of operator maintenance effort and with a corresponding savings of operator risk from having to manually remove trash buildup as in the past.

Figure 15:
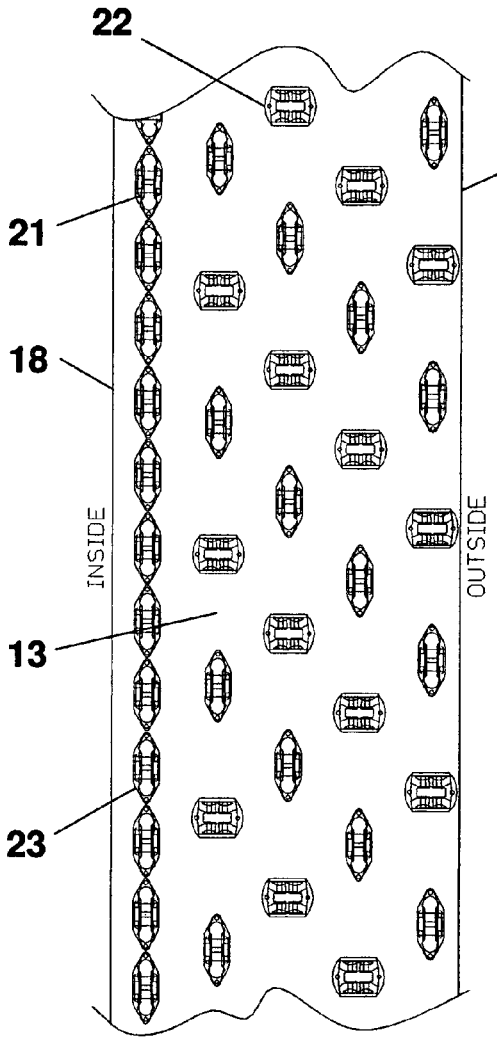
FIGS. 15 and 16 are "unrolled" views of cleat rows showing two of several possible cleat patterns embraced by the present invention.
Figure 16:
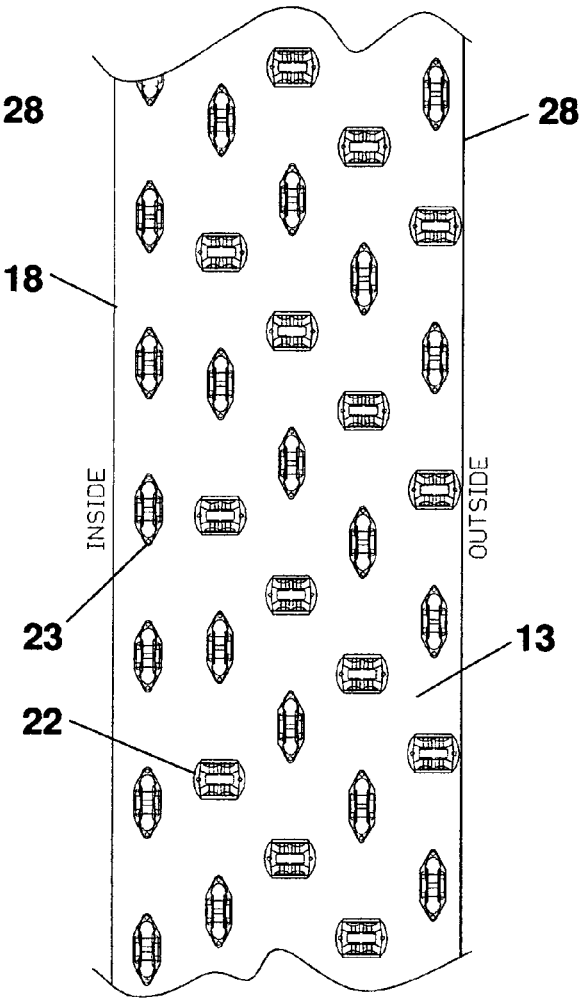

Referring to FIGS. 15 and 16, shown there are two "unrolled" views or flat patterns of cleat rows showing two of several possible cleat patterns embraced by the present invention. The inner row 23" of contour cleats 21 as illustrated in FIG. 15 is positioned on the drum 13 as depicted in FIG. 8, "heel-to-toe". The cleat rows outward of row 23" are each of alternating traction 22 and contour cleats 21.

The inner row 23 of contour cleats 21 shown in FIG. 16 is positioned on the drum 13 as illustrated in FIG. 4 with space between consecutive cleats in the inner row and with an offset as described above. The cleats in rows arranged outward of row 23 are in the alternating pattern of traction cleat 22 followed by a contour cleat 21.

While several configurations of compactor wheels with contour cleats and traction cleats have been disclosed for effectively excluding trash buildup, I do not intend to the practice of the invention to the particular configurations shown herein, but on the contrary it is intended to cover the various alternatives, modifications and equivalent configurations as may be included within the spirit and scope of the invention as defined in the appended claims.

What is claimed is:

1. A compactor wheel with trash exclusion properties mountable on an axle of a compaction vehicle, comprising:

an outer cylindrical drum mountable for rotation on the compaction vehicle axle such that an inner peripheral edge of the drum is disposed adjacent to the compaction vehicle and an outer peripheral edge is disposed away from the compaction vehicle;

a plurality of upstanding compaction cleats circumferentially spaced on and transversely spaced across the face of said drum and rigidly mounted thereto, said cleats being of first and second types, said first compaction cleat type having a base generally elongated in the direction of drum rotation, tapering at each end, and being trapezoidal in profile so as to transmit crushing and grinding forces into the landfill materials without attracting trash materials thereto, said second compaction cleat type having a generally rectangular base and being wedge shape in profile with wedge faces oriented generally in the direction of drum rotation so as to transmit traction forces into the landfill, an innermost row of cleats of the first type mounted adjacent to said inner peripheral edge of the drum;

a plurality of circumferential rows of cleats of both said first and second types disposed on said drum outwardly of said first mentioned row of cleats, said rows of cleats being arranged such that from the inner to the outer peripheral edge of the drum there are no cleat free zones.

2. A compactor wheel constructed as in claim 1 wherein the row of cleats of the first type is disposed immediately proximate the inner edge of the wheel drum.

3. The compactor wheel constructed as in claim 1 wherein the row of cleats of the first type is disposed offset from the inner edge of the outer wheel drum.

4. The compactor wheel constructed as in claim 1 wherein the row of cleats of the first type are welded to the outer drum in a "heel-to-toe" row array extending continuously around the periphery of the drum.

5. The compactor wheel constructed as in claim 4 wherein there are secured to the outer drum axially outwardly of the first mentioned row, cleats of said second type, and rows of spaced apart cleats comprising in each row cleats of both said first and said second types.

6. The compactor wheel constructed as in claim 1 wherein the row of cleats of the first type are welded to the outer drum in a circumferentially spaced apart configuration, and the cleats of said second type are arranged axially outwardly of the first mentioned row in a plurality of rows.

7. The compactor wheel constructed as in claim 6 wherein among the plurality of rows of cleats outwardly of said first mentioned row is a second row of cleats of said first type.

* * * * *